US007886513B2

(12) United States Patent
Kim et al.

(10) Patent No.: US 7,886,513 B2
(45) Date of Patent: Feb. 15, 2011

(54) COMPOSITE YARN AND METHOD OF MANUFACTURING THE SAME

(75) Inventors: Hyun Chel Kim, Jeonju-si (KR); Su Bong Kim, Jeollabuk-do (KR); Wan Jin Kim, Jeonju-si (KR); Woo Yeung Kim, Iksan-si (KR); Won Hwan Oh, Suwon-si (KR)

(73) Assignee: Korea Institute for Knit Industry, Jeollabuk-Do (KR)

( * ) Notice: Subject to any disclaimer, the term of this patent is extended or adjusted under 35 U.S.C. 154(b) by 31 days.

(21) Appl. No.: 12/269,130

(22) Filed: Nov. 12, 2008

(65) Prior Publication Data

US 2009/0151139 A1 Jun. 18, 2009

(30) Foreign Application Priority Data

Dec. 17, 2007 (KR) ..... 10-2007-0132275

(51) Int. Cl.
*D01H 1/10* (2006.01)

(52) U.S. Cl. ..... 57/58.52

(58) Field of Classification Search ..... 57/58.49, 57/58.52, 260

See application file for complete search history.

(56) References Cited

U.S. PATENT DOCUMENTS

| | | | | | |
|---|---|---|---|---|---|
| 2,782,590 | A | * | 2/1957 | Lowe | 57/58.52 |
| 3,327,468 | A | * | 6/1967 | Page | 57/260 |
| 3,349,552 | A | * | 10/1967 | Port et al. | 57/31 |
| 3,382,655 | A | * | 5/1968 | Wasserman | 57/16 |
| 3,735,579 | A | * | 5/1973 | Catlos | 57/260 |
| 4,697,407 | A | * | 10/1987 | Wasserman | 57/238 |
| 2005/0022492 | A1 | * | 2/2005 | Antouly | 57/58.49 |

FOREIGN PATENT DOCUMENTS

| | | |
|---|---|---|
| KR | 20-0352850 | 6/2004 |
| KR | 100654155 | 11/2006 |
| KR | 100689604 | 2/2007 |

* cited by examiner

*Primary Examiner*—Shaun R Hurley
(74) *Attorney, Agent, or Firm*—IPLA P.A.; James E. Bame

(57) ABSTRACT

A method of manufacturing composite yarn by doubling and twisting paper tape and back warp yarn in one process without doubling paper yarn and back warp yarn after fabricating the paper yarn using the paper tape, includes: passing paper tape unwound from a bobbin by external force through the bobbin in an axial direction of the bobbin, and rotating the paper tape together with additionally-supplied back warp yarn about the axis of the bobbin to twist the paper tape and the back warp yarn together.

2 Claims, 4 Drawing Sheets

COMPOSITE YARN AND METHOD OF MANUFACTURING THE SAME

CROSS REFERENCE

This application claims foreign priority under Paris Convention and 35 U.S.C. §119 to Korean Patent Application No. 10-2007-0132275, filed Dec. 17, 2007 with the Korean Intellectual Property Office.

BACKGROUND OF THE INVENTION

1. Field of the Invention

The present invention relates to a method of manufacturing composite yarn by doubling and twisting paper tape and back warp yarn in one process without doubling paper yarn and back warp yarn after fabricating the paper yarn using the paper tape.

2. Description of the Related Art

Recently, the clothing industry has rapidly advanced according to the development of synthetic fiber. However, with the enhancement of living standards and the advancement of civilization, the desire to put on clothes which are environmentally friendly and harmless to the human body has increased. Therefore, efforts to develop natural fiber, such as Korean paper yarn, using Korean paper and to improve the functionality of natural fiber are being made in earnest.

Meanwhile, Korean paper, manufactured using Dak pulp which is a traditional natural fibrous material, is a typical environmentally friendly material harmless to the human body. Since Korean paper has various functional properties such as far-infrared ray emission, antibiosis, deodorizing ability, air permeability, sweat absorbing and quick-drying abilities, lightness of weight and the like, it is in the limelight as a wallpaper for preventing atopic dermatitis. However, since its use is limited to Chinese drawing paper, wrapping paper, craft products and the like, it is required to have a variety of uses.

Conventionally, in the applications of fiber using Korean paper, fiber products were manufactured by slitting Korean paper fabric prepared by craftsmen through a traditional method or by slitting Korean paper and then twisting the slit Korean paper into yarn through manual procedures. However, such fiber products manufactured in this way were faced with dyeing and washing problems and problems of a limitation of the output.

Recently, a technology of manufacturing paper yarn by slitting base paper at a predetermined width and then twisting the slit base paper using a ring spinning frame has been proposed. This technology is advantageous in that both twisting and winding processes can be performed using the ring spinning frame, but is problematic in that the amount of the paper yarn which can be wound on a cone of the ring spinning frame is limited by the size of the ring, and thus paper yarn can not be twisted and wound in large amounts, and in that an additional post-process of connecting the paper yarn wound on a plurality of cones with each other in order to easily manufacture products is required, so that processes are complicated and many workers are required, thereby greatly decreasing productivity.

In order to overcome the above problems, it is disclosed in Korean Patent Registration No. 10-0654155, filed by the present applicant, that, unlike the conventional ring spinning frame, paper yarn can be wound on the cones of a ring spinning frame in large amounts, thereby greatly improving productivity.

However, since the elongation of the paper yarn manufactured by the method disclosed in Korean Patent Registration No. 10-0654155 is not good, when the paper yarn is woven and knitted using a circular knitting machine, an automatic flat knitting machine or a sock knitting machine, drop stitch and yarn breakage frequently occur due to low elongation and repulsion of the paper yarns, and thus it is difficult to weave and knit the paper yarn.

Meanwhile, a technology for improving elastic properties by imparting elongation to low-elongation yarn such as Korean paper yarn was proposed in Korean Utility Model Registration No. 20-352850. The Korean Utility Model Registration No. 20-352850 discloses covered yarn having a structure in which polyurethane elastic yarn is covered with Korean paper yarn at regular intervals. The covered yarn is advantageous in that thick fabrics can be easily manufactured due to the inherent elastic properties of the polyurethane elastic yarn, but is problematic in that since Korean paper yarn of 500~1500 deniers is used, the covered yarn has limited application to generally-used clothes, and, particularly, it is difficult to manufacture textile products.

The present applicant proposed a composite yarn for improving the elongation of low-elongation yarn and a method of manufacturing the same in Korean Patent Registration No. 10-0689604. This composite yarn is advantageous in that, since it has improved elongation and repulsion, drop stitch and yarn breakage do not occur, thus improving weaving and knitting abilities.

However, there are problems in both Korean Utility Model Registration No. 20-352850 and Korean Patent Registration No. 10-0689604 that, since composite yarn is manufactured using paper yarn, a process of manufacturing the composite yarn, the process including the steps of slitting base paper, twisting the slit base paper using paper tape into paper yarn and combining the paper yarn with back warp yarn, is complicated, and thus the productivity of the composite yarn is not good.

SUMMARY OF THE INVENTION

Accordingly, the present invention has been made keeping in mind the above problems occurring in the prior art, and an object of the present invention is to provide a method of manufacturing composite yarn using paper tape without performing a paper yarn preparation process, by which the number of processes is decreased, thus greatly increasing the productivity of the composite yarn.

In order to accomplish the above object, an aspect of the present invention provides a method of manufacturing composite yarn, including: passing paper tape unwound from a bobbin by external force through the bobbin in an axial direction of the bobbin, and rotating the paper tape together with additionally-supplied back warp yarn about the axis of the bobbin to twist the paper tape and the back warp yarn together.

In the method, it is preferred that the back warp yarn be made of one or more selected from among cellulose fibers and synthetic fibers.

Further, another aspect of the present invention provides composite yarn manufactured by the method.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, preferred embodiments of the present invention will be described in detail with reference to the attached drawings.

A method of manufacturing composite yarn includes the processes of axially passing paper tape unwound from a bobbin by external force through the bobbin, and rotating the paper tape together with additionally-supplied back warp yarn about the axis of the bobbin to twist the paper tape and the back warp yarn together.

The paper tape is formed by slitting base paper at a predetermined width. The base paper includes pulp obtained from coniferous trees, broadleaf trees and the like, Korean paper made of a paper mulberry, and the like. Further, if necessary, base paper functionalized in the step of making paper or before or after the step of making paper may be used without limitations.

Further, the back warp yarn is made of one or more selected from among cellulose fibers such as cotton, flax, rayon and the like, and synthetic fibers such as PET, nylon and the like.

Meanwhile, the weight per unit area and width of the paper tape and the kind and fineness of the back warp yarn may be adjusted depending on the use of composite yarn.

Figure 1:
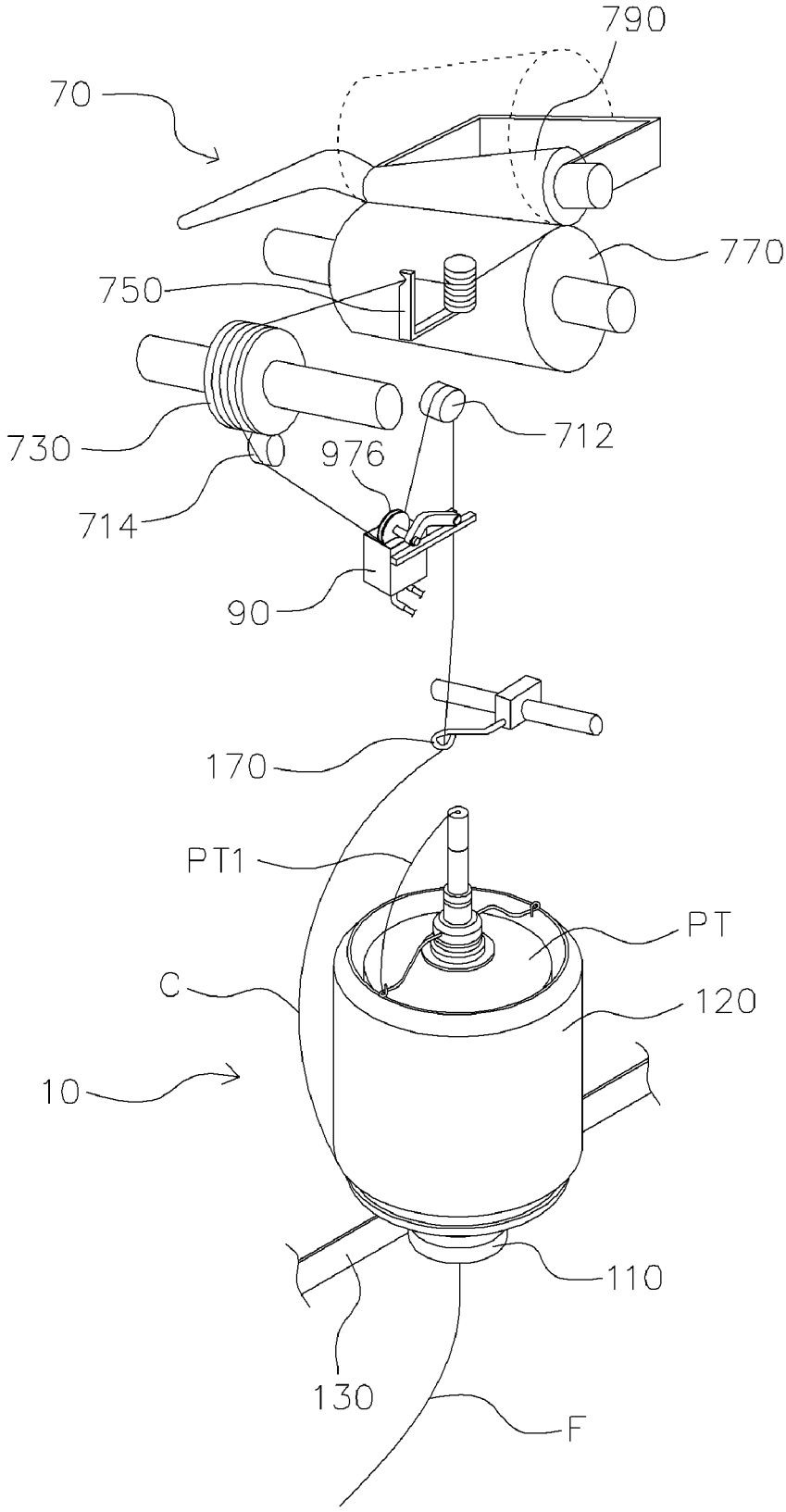
FIG. 1 is a schematic view showing a twisting machine and a winding machine for manufacturing composite yarn of the present invention.
Figure 2:
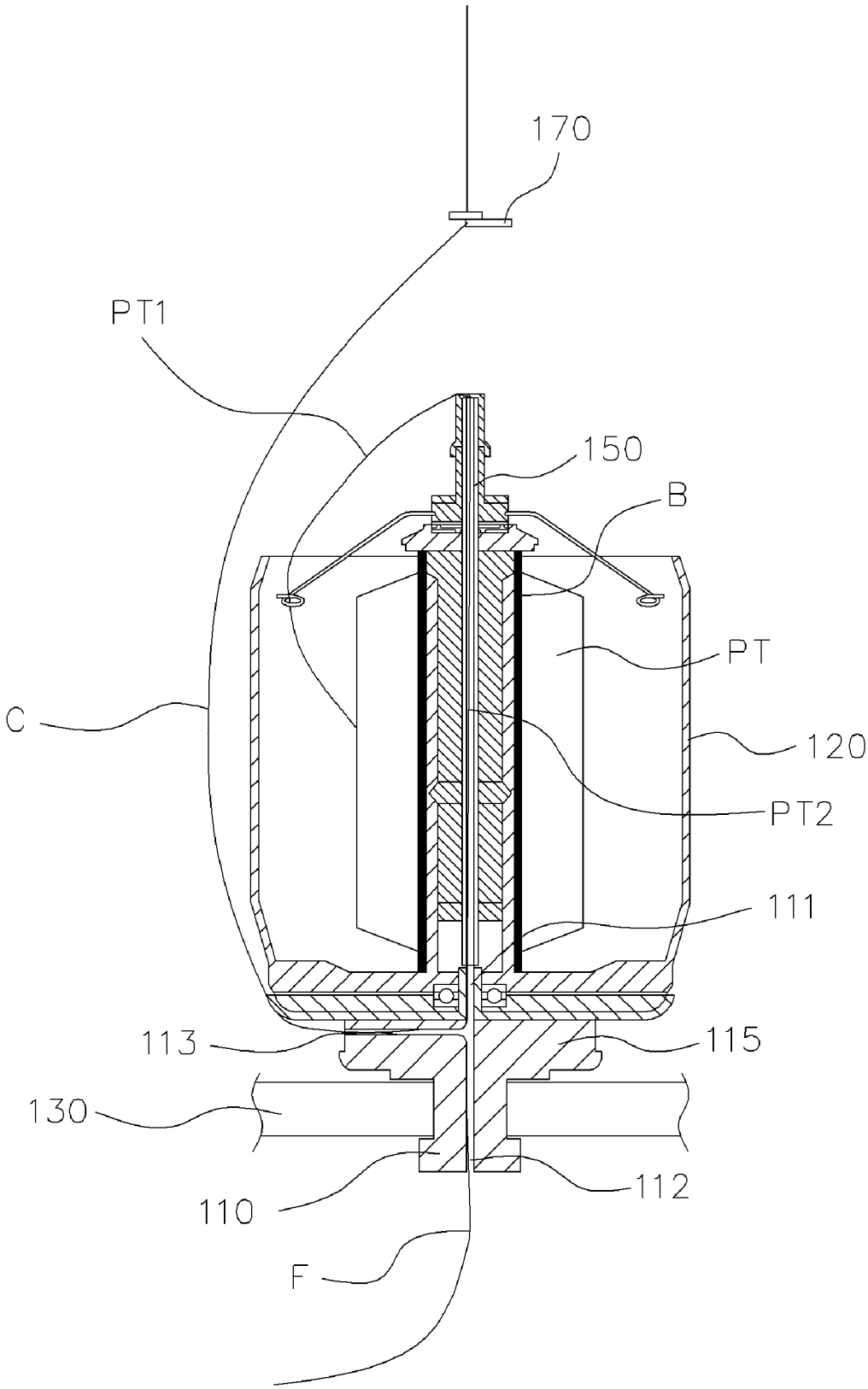
FIG. 2 is a longitudinal sectional view showing the twisting machine.

FIG. 1 is a schematic view showing a twisting machine and a winding machine for manufacturing composite yarn of the present invention, and FIG. 2 is a longitudinal sectional view showing the twisting machine.

As shown in FIGS. 1 and 2, the twisting machine 10 for manufacturing composite yarn includes a spindle 110 integrally provided with a turntable 115, a protective case 120 which is supported on the spindle 110 and whose top portion is open, and a yarn introduction pipe 150 which rotatably supports a bobbin (B) wound with paper tape (PT) and which guides paper tape (PT) unwound from the bobbin (B) to a first inlet 111 formed in the upper end of the spindle 110. The bobbin (B) wound with the paper tape (PT) is rotatably supported on the yarn introduction pipe 150.

The spindle 110 is rotated by a driving member such as a belt in one direction, and thus the turntable 115 integrally provided with the spindle 110 is also rotated in the one direction.

The spindle 110 is provided in the upper and lower ends thereof with a first inlet 111 and a second inlet 112, respectively, and the turntable 115 is provided in one side thereof with an outlet 113 communicating with the first inlet 111 and second inlet 112.

The paper tape (PT1) unwound from the bobbin (B) is introduced into the yarn introduction pipe 150 through the first inlet 11, and is then pulled out through the outlet 113. The paper tape (PT) is unwound from the fixed bobbin (B) and then introduced into the yarn introduction pipe 150, and thus the paper tape (PT2) introduced into the yarn introduction pipe 150 is twisted to some degree.

Further, back warp yarn (F) wound on another bobbin is introduced into the second inlet 112, and is then pulled out through the outlet 113 together with the paper tape (PT2) introduced through the first inlet 111.

Having passed through the outlet 113, the paper tape and back warp yarn (C) pass through a balloon guide 170 located over the yarn introduction pipe, and then are wound on a cone 790 by a winding machine 70.

The paper tape and back warp yarn (C) located between the outlet 113 and the balloon guide 170 are ballooned and twisted by centrifugal force, thus doubling and twisting the paper tape and back warp yarn (C). Specifically, the paper tape (PT2) twisted to some degree in the yarn introduction pipe 150 is completely twisted by a balloon phenomenon and simultaneously doubled and twisted with the back warp yarn (F), thereby obtaining composite yarn.

The winding machine 70 includes first and second guide rollers 712 and 714 for changing the direction of movement of the composite yarn having passed through the balloon guide 170 and then supplying the composite yarn to a supply roller 730, the supply roller 730 for supplying the composite yarn having passed through the second guide roller 714 to a traverse guide 750, the traverse guide 750 for moving the composite yarn supplied from the supply roller 730 back and forth, and a winding drum 770 which comes into contact with the cone 790 to wind the composite yarn having passed through the traverse guide 750 on the cone 790 by the rolling movement of the cone 790.

The composite yarn passes through the balloon guide 170 and then sequentially passes through the first guide roller 712, the second guide roller 714, the supply roller 730 and the traverse guide 750. Subsequently, the composite yarn having passed through the traverse guide 750 moving back and forth is wound on the cone 790 coming into contact with the winding drum 770 and conducting rolling movement.

Figure 3:
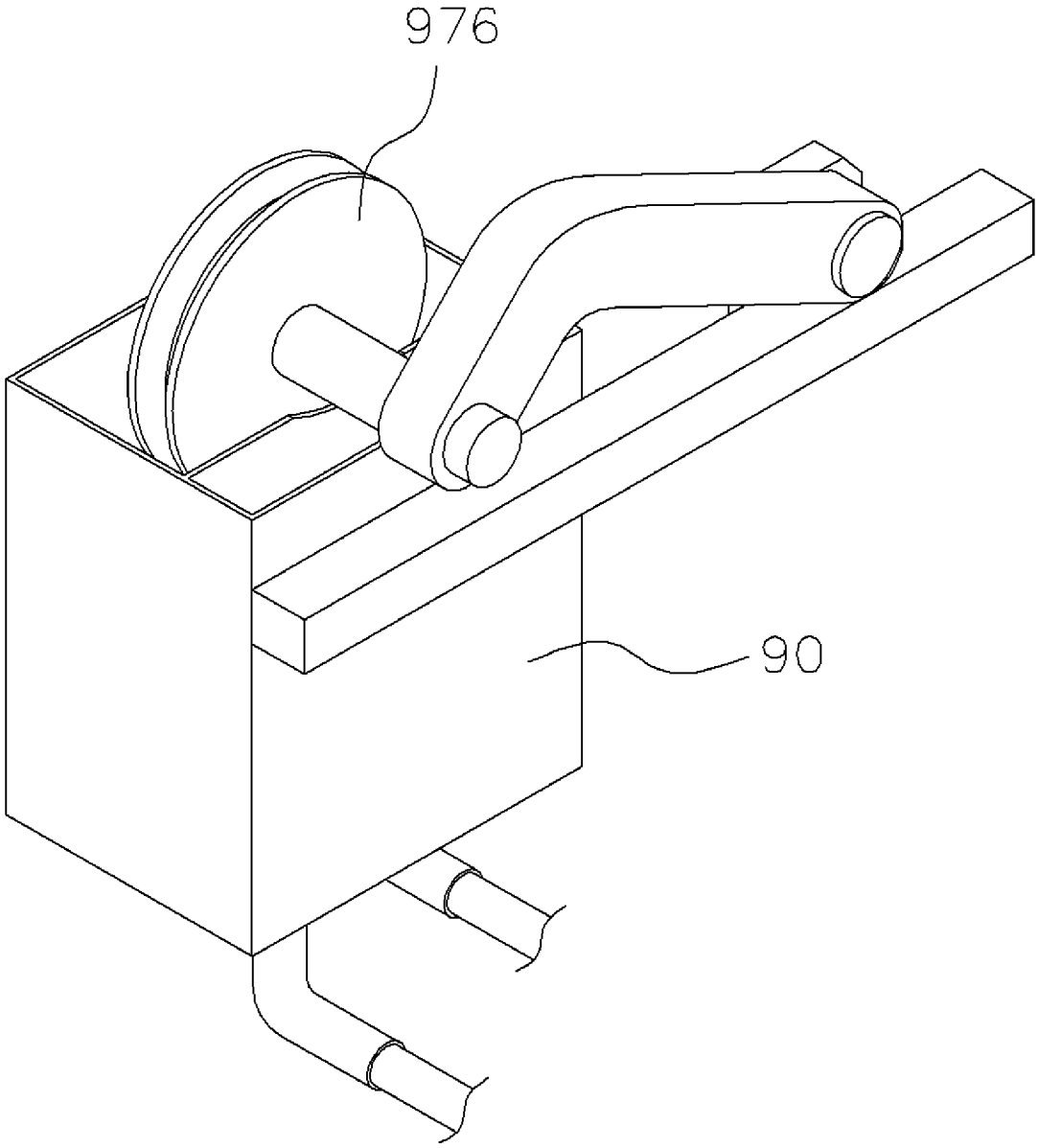
FIG. 3 is a schematic view showing a water tank in which a roller is immersed.

FIG. 3 is a schematic view showing a water tank in which a roller is immersed.

Meanwhile, the water tank 90 in which a roller 976 is immersed may be provided between the first guide roller 712 and the second guide roller 714 as shown in FIGS. 1 and 3. When water is supplied to paper tape using the water tank 90 in which the roller 976 is immersed, the paper tape is uniformly twisted, thereby obtaining uniformly twisted composite yarn.

Hereinafter, the method of manufacturing composite yarn according to the present invention will be described in more detail with reference to the following Examples. However, the scope of the present invention is not limited thereto.

EXAMPLE 1

Figure 4:
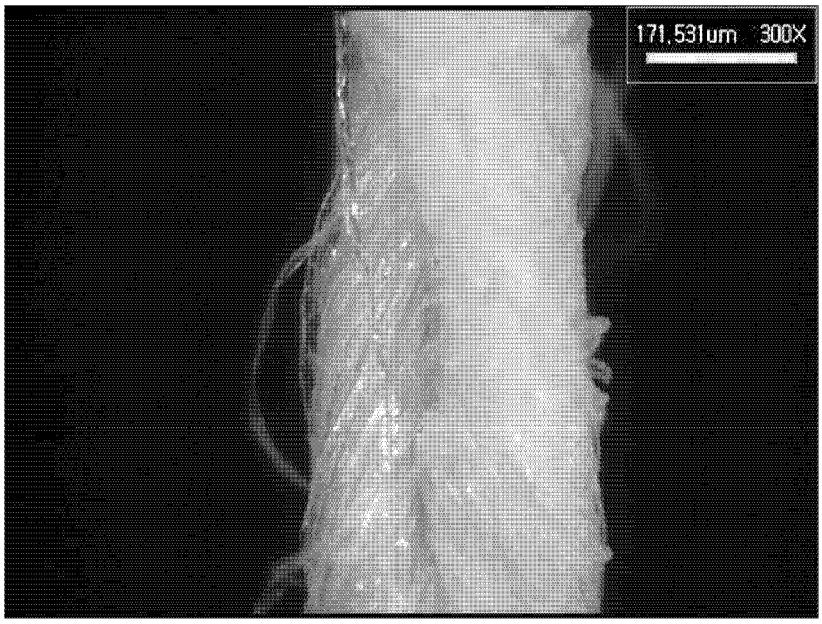
FIG. 4 is an electron microscope photograph showing the composite yarn of Example 1.

Korean paper slit at a width of 1.3 mm was used as paper tape, and cotton yarn of 133 deniers was used as back warp yarn. The paper tape and cotton yarn were twisted using the twisting machine shown in FIG. 1, thereby manufacturing composite yarn. During the manufacturing of the composite yarn, yarn breakage did not occur. The electron microscope photograph of the manufactured composite yarn is shown in FIG. 4. The manufactured composite yarn exhibited a fineness of 300 deniers, a strength of 1.42 g/d, an elongation of 5.2% and a uniformity index of 9.0 U %.

EXAMPLE 2

Figure 5:
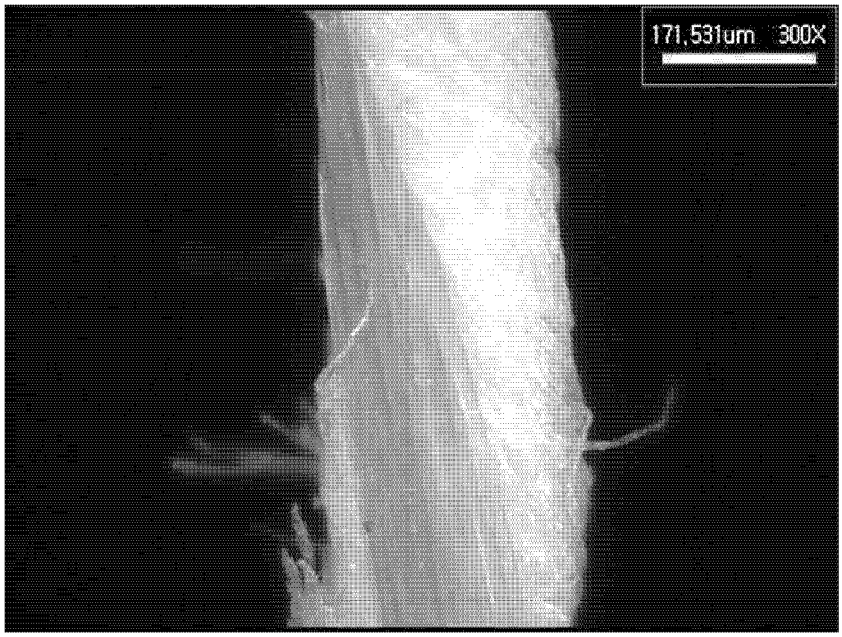
FIG. 5 is an electron microscope photograph showing the composite yarn of Example 2.

Korean paper slit at a width of 1.3 mm was used as paper tape, and cotton yarn of 75 deniers was used as back warp yarn. The paper tape and cotton yarn were twisted using the twisting machine shown in FIG. 1, thereby manufacturing composite yarn. During the manufacturing of the composite yarn, yarn breakage did not occur. The electron microscope photograph of the manufactured composite yarn is shown in FIG. 5. The manufactured composite yarn exhibited a fineness of 350 deniers, a strength of 1.24 g/d, an elongation of 5.5% and a uniformity index of 9.0 U %.

In Examples 1 and 2, since the paper tape and backwarp yarn were doubled and twisted in one process without performing an additional process of preparing paper yarn, thus manufacturing composite yarn having excellent physical properties and improved uniformity.

As described above, unlike the conventional composite manufacturing method, the method of manufacturing composite yarn according to the present invention is advantageous in that, since the composite yarn is manufactured by doubling and twisting paper tape and back warp yarn in one process without doubling paper yarn and back warp yarn after fabricating the paper yarn using the paper tape, so that the number of processes is decreased, thus greatly increasing the productivity of the composite yarn, and composite yarn having improved strength and elongation can be manufactured.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of manufacturing composite yarn, in which the composite yarn is manufactured using a twister comprising a spindle provided on upper and lower ends thereof with a first inlet and a second inlet, respectively, a turntable integrated with the spindle and provided in one side thereof with an outlet communicating with the first inlet and the second inlet, a protective case which is supported on the spindle and whose top portion is open, and a yarn introduction pipe which rotatably supports a bobbin wound with paper tape and which guides paper tape unwound from the bobbin to the first inlet of the spindle, comprising the steps of:

introducing the paper tape unwound from the bobbin into the first inlet of the spindle through the yarn introduction pipe; and introducing back warp yarn into the second inlet of the spindle, pulling out the back warp yarn through the outlet together with the paper tape introduced into the first inlet, and then rotating the spindle to double and twist the paper tape and the back warp yarn together.

2. The method of manufacturing composite yarn according to claim 1, wherein the back warp yarn is made of one or more selected from among cellulose fibers and synthetic fibers.

* * * * *